US006078764A

United States Patent [19]

Akutsu

[11] Patent Number: 6,078,764

[45] Date of Patent: Jun. 20, 2000

[54] PROCESS CARTRIDGE AND ELECTROSTATIC IMAGE FORMING APPARATUS

[75] Inventor: Takashi Akutsu, Toride, Japan

[73] Assignee: Canon Kabushiki Kaisha, Tokyo, Japan

[21] Appl. No.: 09/177,122

[22] Filed: Oct. 22, 1998

[30] Foreign Application Priority Data

Oct. 22, 1997 [JP] Japan ..... 9-307867
Oct. 9, 1998 [JP] Japan ..... 10-303242

[51] Int. Cl.[7] ..... G03G 15/00; G03G 21/18

[52] U.S. Cl. ..... 399/114; 399/111

[58] Field of Search ..... 399/114, 113, 399/111, 110; 347/138, 152

[56] References Cited

U.S. PATENT DOCUMENTS

| | | | |
|---|---|---|---|
| 4,462,677 | 7/1984 | Onoda | 399/114 |
| 4,609,276 | 9/1986 | Mitzutani | 399/111 |
| 4,708,455 | 11/1987 | Kubota et al. | 399/111 |
| 5,589,918 | 12/1996 | Oshida et al. | 399/114 |
| 5,617,579 | 4/1997 | Yashiro et al. | 399/114 |
| 5,749,027 | 5/1998 | Ikemoto et al. | 399/113 |
| 5,878,304 | 3/1999 | Watanabe et al. | 399/114 X |
| 5,937,242 | 8/1999 | Yokoyama et al. | 399/114 |

FOREIGN PATENT DOCUMENTS

| | | |
|---|---|---|
| 7-295317 | 11/1995 | Japan . |
| 8-160835 | 6/1996 | Japan . |

*Primary Examiner*—Sophia S. Chen
*Attorney, Agent, or Firm*—Fitzpatrick, Cella, Harper & Scinto

[57] ABSTRACT

A process cartridge detachably mountable to a main assembly of an electrophotographic image forming apparatus includes a cartridge frame; an electrophotographic photosensitive member; a process device actable on the photosensitive member; a shutter for covering a portion of the photosensitive member which is otherwise exposed; a shutter supporting member for supporting the shutter on the cartridge frame, for movement between a protecting position for covering the photosensitive member to protect it and a retracted position for permitting the photosensitive member to be exposed; a force receiving portion for receiving, when the process cartridge is mounted to the main assembly of the image forming apparatus, a force for urging the shutter supporting member longitudinally inwardly of the process cartridge, wherein the force receiving portion is contactable to the main assembly when the process cartridge is mounted to the main assembly; and a stopper for limiting movement of the shutter supporting member beyond a predetermined distance to prevent the shutter member from disengaging from the cartridge frame, when the shutter supporting member moves in the longitudinal direction of the shutter.

13 Claims, 10 Drawing Sheets

PROCESS CARTRIDGE AND ELECTROSTATIC IMAGE FORMING APPARATUS

FIELD OF THE INVENTION AND RELATED ART

The present invention relates to a process cartridge removably mountable in an electrophotographic image forming apparatus. The term "electrophotographic image forming apparatus" refers to an apparatus which forms an image on a piece of a recording medium with the use of an electrophotographic image forming system. Example of such an image forming apparatus includes electrophotographic copying machines, electrophotographic printers (laser beam printers, LED printers, and the like), facsimile apparatuses, word processors, and the like.

The term "process cartridge" refers to a cartridge, which is removably mountable in the main assembly of an image forming apparatus, and in which processing means, which are a charging means, a developing means, and a cleaning means, and an electrophotographic photosensitive member, are integrally disposed. It also refers to a cartridge, which is removably mountable in the main assembly of an image forming apparatus, and in which at least one processing means, which can be a charging means, a developing means, or a cleaning means, and an electrophotographic photosensitive member, are integrally disposed. It also refers to a cartridge removably mountable in the main assembly of an image forming apparatus, and in which a minimum of developing means and an electrophotographic image forming apparatus are integrally disposed.

A process cartridge system has been in use for quite some time, and employs a process cartridge, which is configured to be removably mountable in the main assembly of an image forming apparatus, and in which an electrophotographic photosensitive member and processing means, which acts upon the electrophotographic photosensitive member, are integrally disposed. With the use of this process cartridge system, an electrophotographic image forming apparatus does not need service personnel; it can be maintained by users themselves, drastically improving operational efficiency. Thus, an image forming apparatus which employs this process cartridge system has come to be widely used.

A process cartridge is completely taken out of the main apparatus of an image forming apparatus at the time of cartridge exchange or the like. Therefore, it must be assured that dust does not adhere to the electrostatic photosensitive member, or the electrophotographic photosensitive member is not damaged, when a process cartridge is out of the main assembly of an image forming apparatus. Further, in order to prevent the photosensitive member from deteriorating due to its exposure to light, it must be prevented from being exposed to light. Thus, some process cartridge are equipped with a shutter for protecting the photosensitive member, or preventing light from entering the process cartridge.

A process cartridge comprises a shutter for preventing the photosensitive member from being exposed to external light when the process cartridge is out of the main assembly of an image forming apparatus, a cartridge frame for supporting the shutter, and a shutter supporting portion which links the cartridge frame and the shutter, and is structured so that as the process cartridge is inserted into the main assembly of an image forming apparatus, a portion of a shutter supporting member comes in contact with the shutter catching portion of the main assembly of the image forming apparatus, being thereby caused to open the shutter.

The present invention is a result of the further development of the above described conventional art.

A primary object of the present invention is to provide a process cartridge and an electrophotographic image forming apparatus, which are capable of reliably moving the shutter of the process cartridge to a shutter retreat position as the process cartridge is inserted into the main assembly of an image forming apparatus.

Another object of the present invention is to provide a process cartridge and an electrophotographic image forming apparatus, which are capable of reliably moving the shutter of the process cartridge to the shutter retreat portion as the process cartridge is inserted into the main assembly of the electrophotographic image forming apparatus, and yet are not larger in size, or higher in cost, than a conventional process cartridge and a conventional electrophotographic image forming apparatus, respectively.

Another object of the present invention is to provide a process cartridge, the shutter supporting portion of which comprises contact portions which come in contact with the internal surface of the cartridge mounting space of the main assembly of an image forming apparatus, and catch the reactional force from the main assembly side of an image forming apparatus, when the process cartridge is mounted into the main assembly of an image forming apparatus, and an electrophotographic image forming apparatus in which such a process cartridge is removably mountable.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Embodiment 1

Hereinafter, the process cartridge in this embodiment, and an image forming apparatus in which this process cartridge is mountable, will be described in detail with reference to FIGS. 1–5. As for the order of description, the general structure of the process cartridge, and the general structure of the image forming apparatus in which the process cartridge is mountable, will be first described with reference to FIGS. 3–5, and the, the shutter will be described with reference to FIGS. 1 and 2.

General Structure

Figure 3:
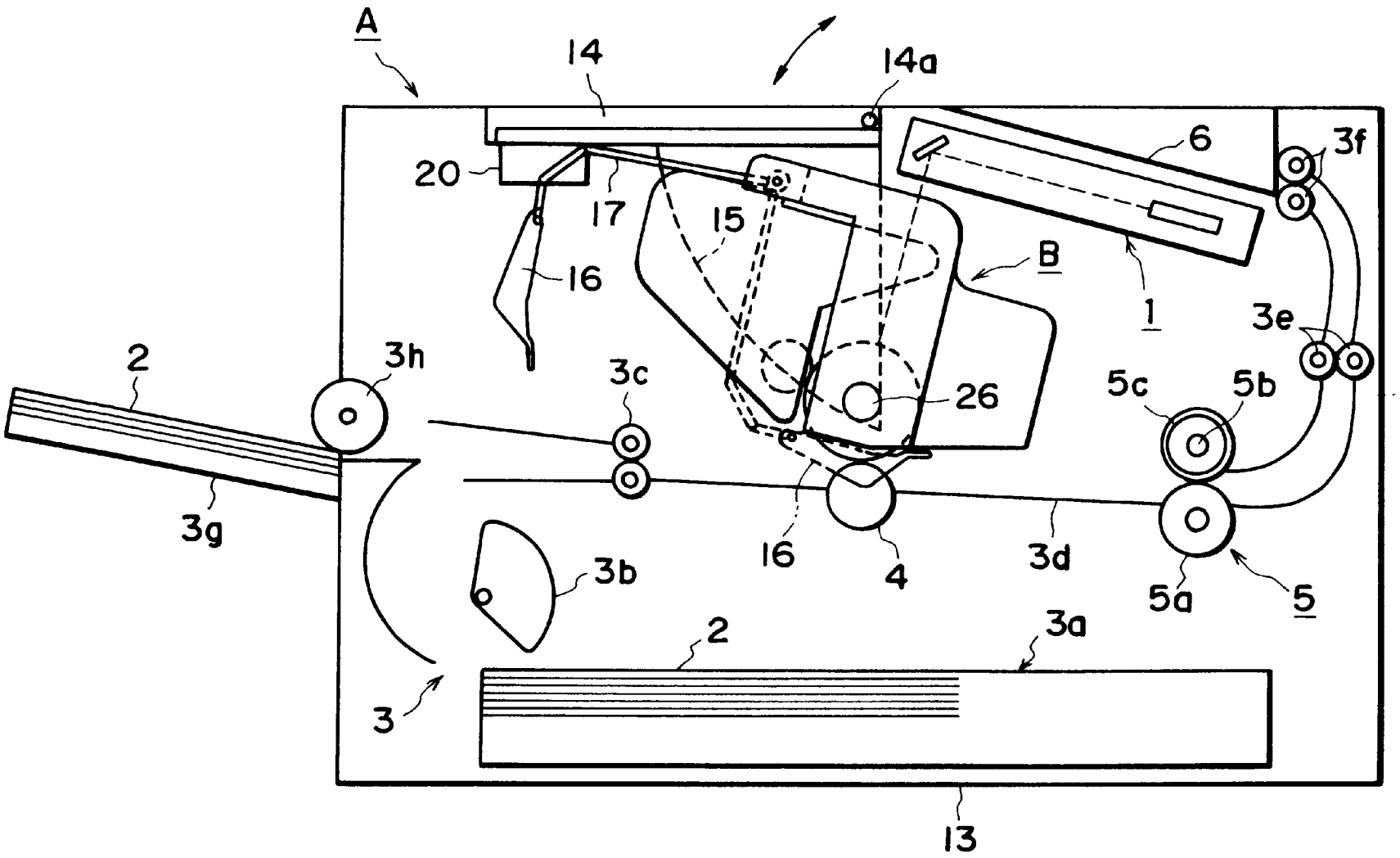
FIG. 3 is a schematic cross section of an image forming apparatus in accordance with the present invention, and depicts its general structure.

Referring to FIG. 3, in the electrophotographic image forming apparatus A (laser beam printer), first, a laser beam modulated with image data is projected on the electrophotographic photosensitive member in the form of a drum (hereinafter, "photosensitive drum"), forming an electrostatic latent image on the photosensitive drum. Then, this latent image is developed into a toner image. In synchronism with the formation of the toner image, a piece of recording medium 2 is delivered from a cassette 3*a*, by a conveying means 3, which has a pickup roller 3*b*, a pair of registration rollers 3*c*, and the like. The toner image formed on the photosensitive drum is transferred onto the recording medium 2 by applying voltage to a transfer roller 4 as the transferring means. The recording medium onto which the toner image has been transferred is guided by a guiding plate 3*d*, to a fixing means 5, which comprises a driving roller 5*a*, and a fixing roller 5*b* which contains a heater 5*c*. While the recording medium 2 is passed through the fixing means 5, the fixing means 5 fixes the toner image to the recording medium 2 by the application of heat and pressure. Thereafter, the recording medium 2 is further conveyed by a pair of conveyer rollers 3*e*, and then is discharged into a delivery surface by a pair of discharge rollers 3*f*. This image forming apparatus A is equipped with a manual feed tray 3*g* and a roller 3*h*, so that it can be manually fed with the recording medium 2.

Figure 4:
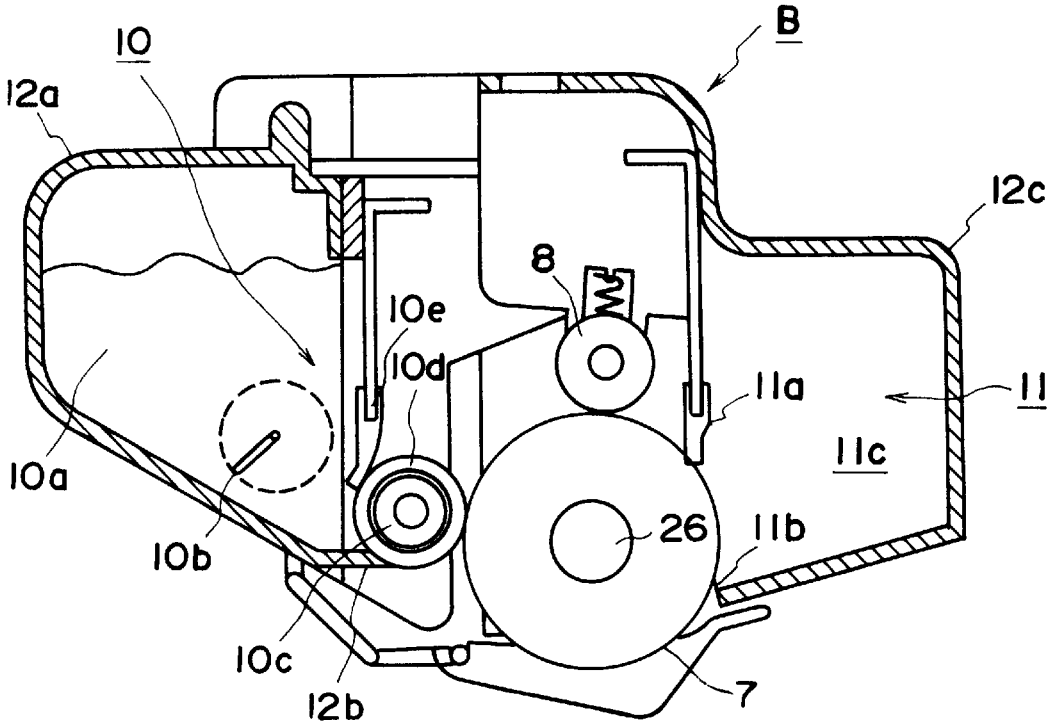
FIG. 4 is a schematic vertical section of a process cartridge in accordance with the present invention, and depicts its general structure.

As for the process cartridge B, it comprises an electrophotographic photosensitive member, and at least one of the processing means, which are the charging mean for charging the electrophotographic photosensitive member, the developing means for developing the latent image formed on the electrophotographic photosensitive member, the cleaning member for cleaning the toner particles which remain on the peripheral surface of the electrophotographic photosensitive member, and the like means. Referring to FIG. 4, in the process cartridge B in this embodiment, the photosensitive drum 7 is rotated, and its peripheral surface is uniformly charged by applying voltage to a charge roller 8 (charging member) as the charging means. Then, image data carrying light is projected onto the photosensitive drum 7 from the aforementioned optical system, forming an electrostatic latent image. The thus formed electrostatic latent image is developed by a developing means. More specifically, the developing means 10 sends out the toner in the toner holding portion 10*a*, toward the rotating development roller 10, by the toner feeding member 10*b*. Then, the toner is picked up by the peripheral surface of the development roller 10*d*, in which a magnet 10*c* is fixedly disposed. As the development roller 10*d* is rotated, the toner on the peripheral surface of the development roller 10*d* is leveled into a toner layer, while being triboelectrically charged, by the development blade 10*e*. Then, the triboelectrically charged toner is allowed to transfer onto the photosensitive drum 7 in response to the potential level pattern, i.e., the latent image, on the peripheral surface of the photosensitive drum 7. As a result, a toner image is formed on the peripheral surface of the photosensitive drum 7. Then, the toner image is transferred onto a piece of recording medium 2 by applying to the transfer roller 4, a voltage with a polarity opposite to that of the toner image. After the toner image transfer, the toner that remains on the photosensitive drum 7 is removed by the aforementioned cleaning means 11. More specifically, the toner remaining on the photosensitive drum 7 is scraped off by the cleaning blade 11*a*, and is scooped up by the squeezing sheet 11*b*, being thereby collected into the waste toner bin 11*c*. The choice of a cleaning means does not need to be limited to such a cleaning means as the cleaning means 11 in this embodiment which comprises the blade 11*a*, the squeezing sheet, and the waste toner bin 11*c*. The developing unit and the cleaning unit are coupled by rotatably coupling the developing frame 12*b* and the drum frame 12*c*.

In this embodiment, the frame of the process cartridge B consists of three sub-frames: a toner frame 10*a*, which constitutes the toner container 12*a* for holding the toner; a development frame 12*b*, which supports image developing members such as the development roller 10*d*; and a drum frame 12*c*, in which the photosensitive drum 7, the cleaning means 11, and the like, are disposed. In manufacturing the process cartridge B, first, the toner frame 11*a* and the development frame 12*b* are welded together, forming the development unit, and then, to this development unit, the cleaning unit is connected. The process cartridge B is removably mounted into the cartridge mounting means provided in the main assembly 13 of the image forming apparatus.

Figure 5:
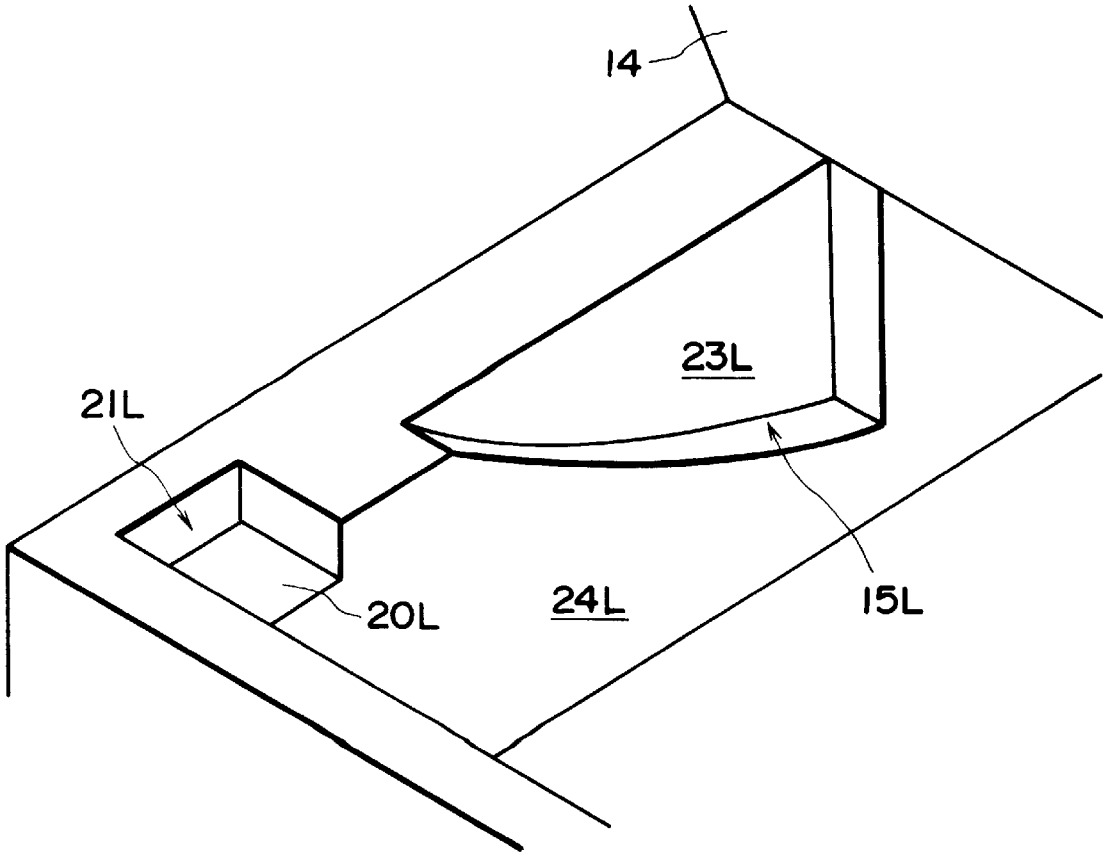
FIG. 5 is a perspective view of the process cartridge mounting space, and the area adjacent thereto, of a process cartridge in accordance with the present invention.

Referring to FIG. 5, the cartridge mounting means is provided with cartridge mounting guides 15L and 15R, which are positioned on the left and right wall, respectively, of the cartridge space, squarely facing each other (FIG. 5 shows only one of the longitudinal ends of process cartridge), and guide the process cartridge B when the process cartridge B is inserted into the main assembly 13. In order to mount the process cartridge B into the main assembly 13, first, a cover 14 must be opened by rotating it about a shaft 14*a*. Then, the process cartridge B must be inserted while allowing the left and right bosses 26 of the process cartridge B, which project from the left and right ends, respectively, of the process cartridge B, to be guided by the guides 15L and 15R. Then, as the cover 14 is closed, the mounting of the process cartridge B into the image forming apparatus A is completed. Further, the cartridge frame is provided with guide members 28 (FIG. 13), which are located on the trailing end side of the boss 26 in terms of the direction in which the process cartridge B is inserted.

They are guided by the guide 15L and 15R, on the apparatus main assembly side.

Shutter

The process cartridge B is provided with a shutter.

Figure 6:
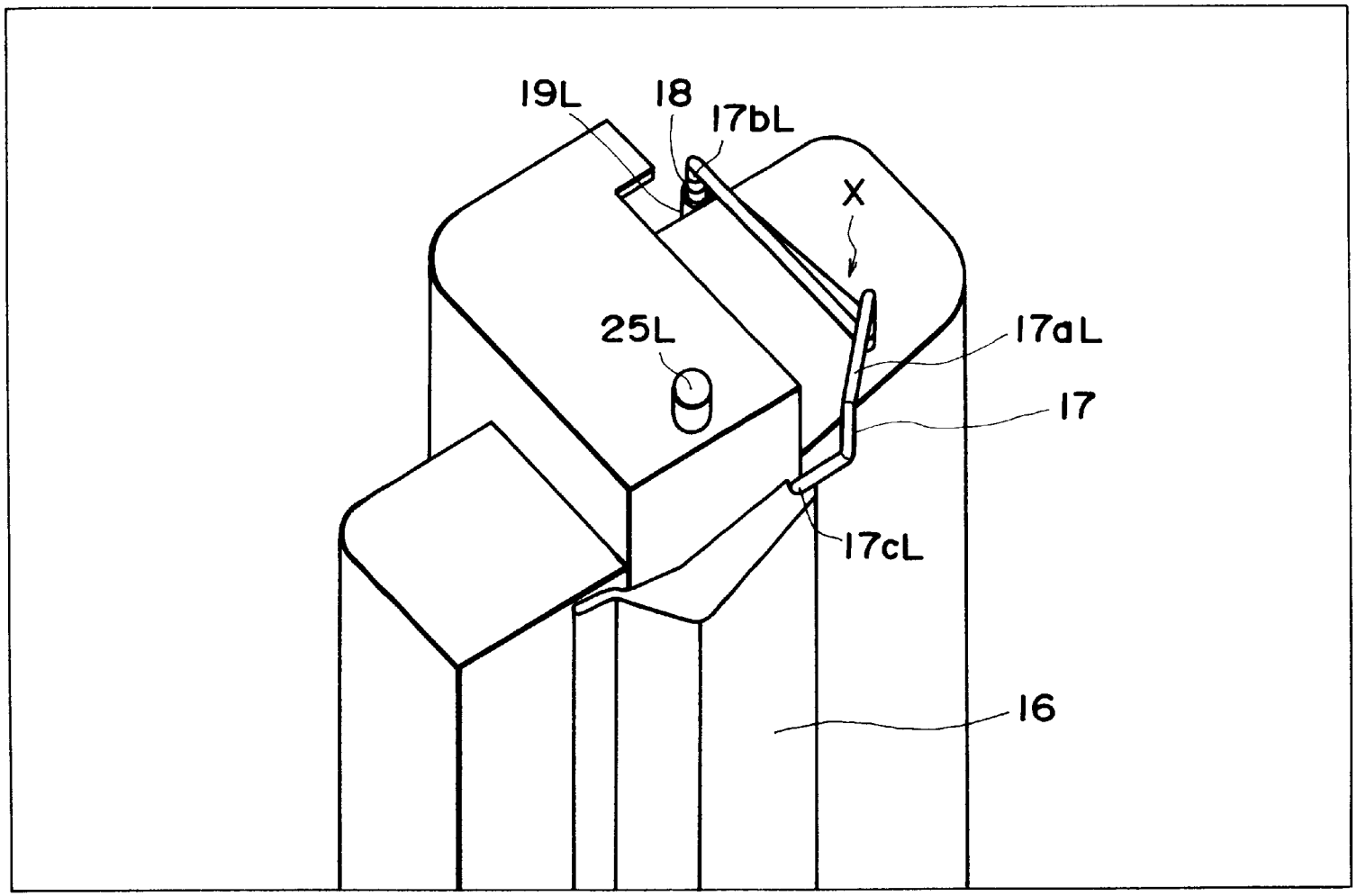
FIG. 6 is a perspective view of one of the longitudinal ends of a process cartridge in accordance with the present invention, and depicts the structure of the drum shutter.
Figure 7:
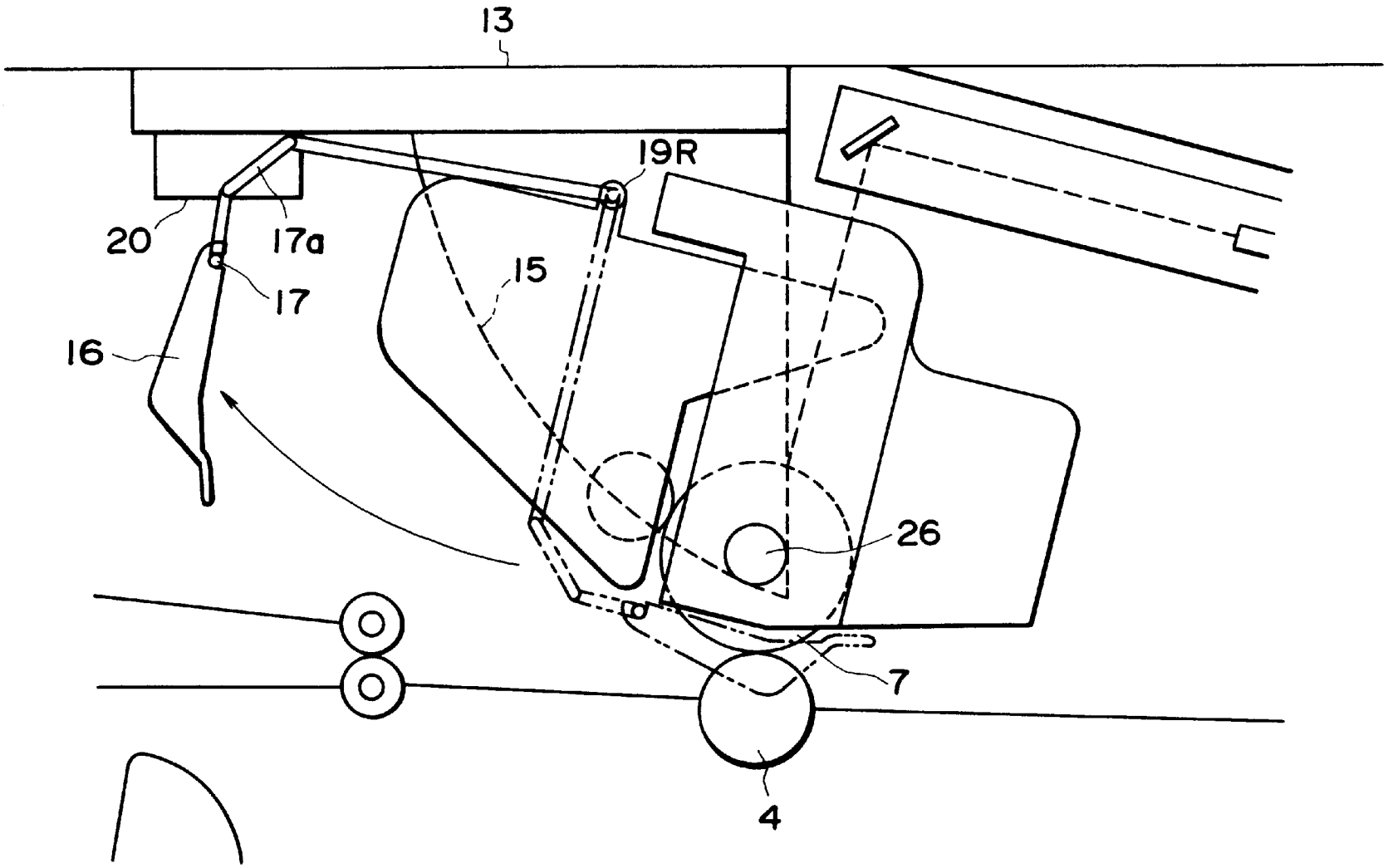
FIG. 7 is a plan view of one of the longitudinal ends of the process cartridge in accordance with the present invention, in the main assembly of an image forming apparatus, and depicts the operation of the shutter.

Referring to FIGS. 6 ad 7, the process cartridge B equipped with the aforementioned shutter will be described. FIG. 6 is a perspective view of the left side of the process cartridge B. FIG. 7 is a drawing for depicting the movement of the shutter, which occurs when the process cartridge B is mounted into the apparatus main assembly 13.

Figure 13:
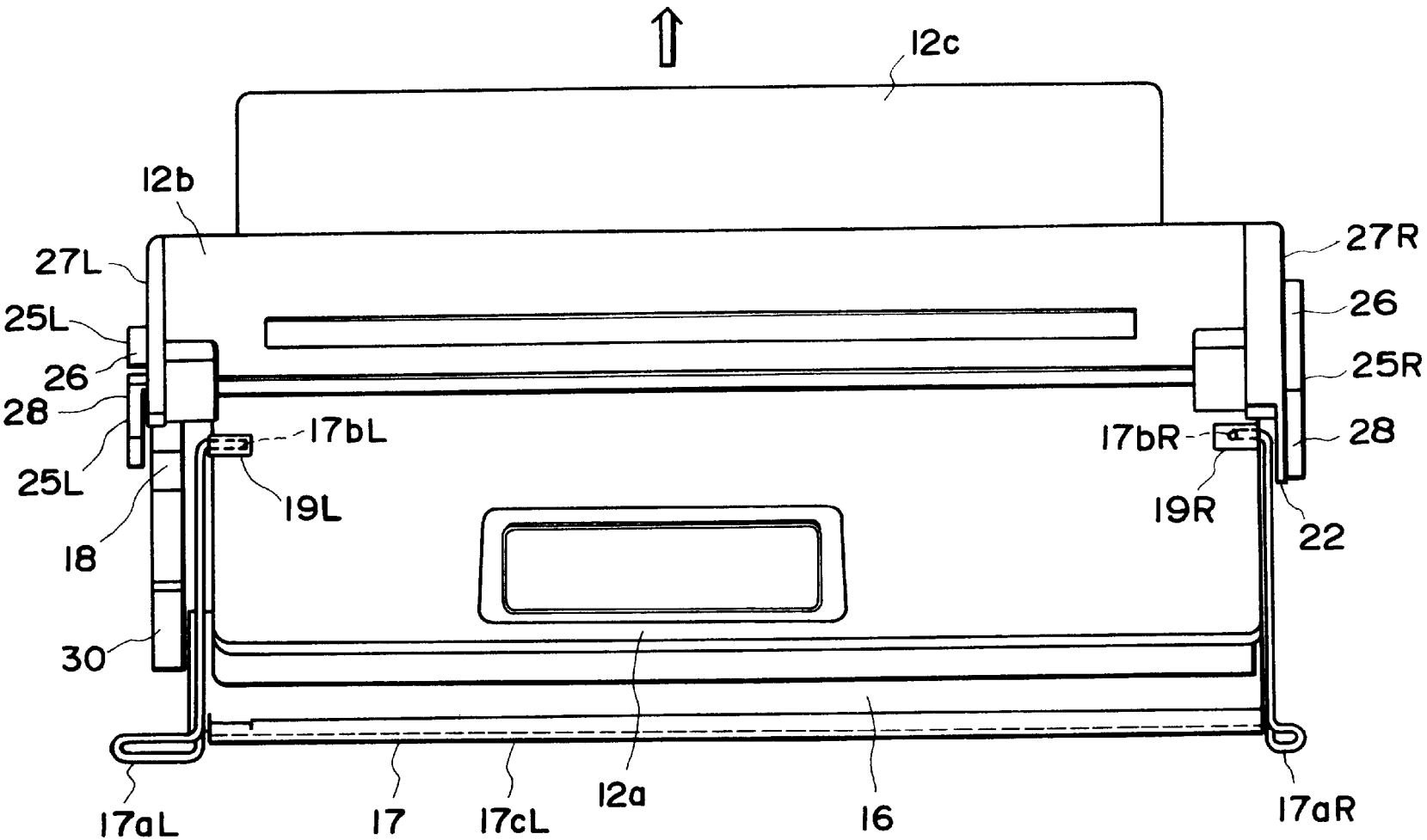
FIG. 13 is a plan view of a process cartridge when the process cartridge is in the main assembly of an image forming apparatus (shutter being open).

As shown in FIG. 6, the shutter mechanism in this embodiment comprises a shutter 16 for protecting the photosensitive drum 7, a shutter rod 17 as a shutter supporting member, which rotatively attaches the shutter 16 to the cartridge frame, and a resilient member 18 for keeping the shutter 16 at the shut position (protective position). The shutter 16 is a member for covering the exposure opening of the cartridge frame to prevent the photosensitive drum 7 from being exposed to the external light when the process cartridge is out of the apparatus main assembly. The shutter 16 looks like a piece of board, being integrally connected to the shutter rod 17. On the side opposite to the side depicted in FIG. 6, the shutter 16 is supported by a link 30, as well as the shutter rod 17. These three members, that is, the link 30, the shutter rod 17, and the shutter 16, and the cartridge frame, form the four piece shutter mechanism link. The shutter rod 17 has projecting portions 17*a*L and 17*a*R, which are positioned on the left and right side, respectively, to open the shutter 16. The shutter rod 17 is formed by bending a piece of steel wire with a diameter of approximately 2 mm. The longitudinal ends 17*b*L and 17*b*R of the shutter rod 17 are fitted in the shutter rod holes 19L and 19R, respectively, of the development unit, so that the shutter rod 17 is allowed to freely rotate relative to the cartridge frame, with the longitudinal ends 17*b*L and 17*b*R acting as an rotational axis. Further, the center portion 17*c*L of the shutter rod 17 is fitted in the shutter 16, along the longitudinal edge of the shutter 16, coming out of both the longitudinal ends of the shutter 16 (FIG. 13). The resilient member 18 is a torsional coil spring, for example, which is integrally assembled with the rotational axis 17*b*L of the shutter rod 17, constantly pushing the shutter 16 in the direction indicated by an arrow mark X, with its resiliency (FIG. 6). Therefore, when the process cartridge B is out of the apparatus main assembly 13, the shutter is kept at the protective position, in which the shutter protects the photosensitive drum 7. In other words, the shutter 16 remains constantly subjected to the resiliency of the resilient member 18 (spring) which acts in the direction to close the shutter 16.

Referring to FIG. 7, in mounting the process cartridge B into the apparatus main assembly 13, first, the projecting portions 17*a* (17*a*L and 17*a*R) of the shutter rod 17 come in contact with the shutter catching portions 20 (20L and 20R) on the apparatus main assembly side, as the process cartridge B is inserted into the apparatus main assembly. Then, as the process cartridge B is inserted farther, the shutter catching portions 20 cause the shutter 16 to move back to the retreat position, i.e., the open position, exposing thereby the photosensitive drum 7 to the transfer roller 4.

In this embodiment, the shutter rod 17 and the apparatus main assembly 13 are configured so that their dimensional relationship assures that the projecting portion 17*a*L, as the contact point, of the shutter rod 17, on the left-hand side (FIG. 1), comes in contact with the side surface 21L of the apparatus main assembly 13, which is on the outward side of the shutter catching portion 20L of the apparatus main assembly 13, and also that the projecting portion 17*a*R of the shutter rod 17 does make contact with the shutter catching portion 20R, but does not come in contact with the side surface 21R of the apparatus main assembly 13, which is on the outward side of the shutter catching portion 20R of the apparatus main assembly 13.

Figure 1:
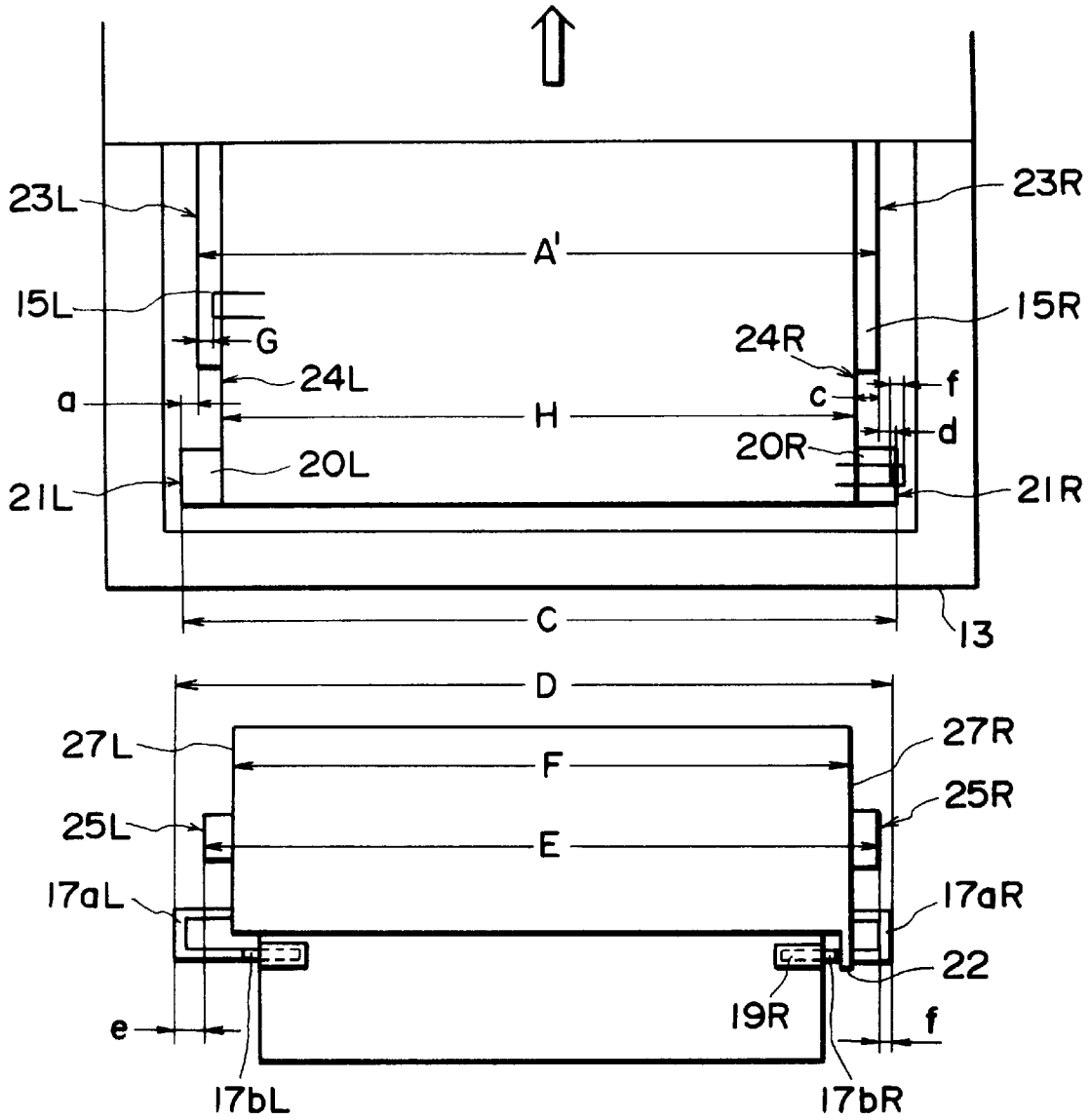
FIG. 1 is a top plan view of the process cartridge entrance portion of the main assembly of an image forming apparatus in accordance with the present invention, and a process cartridge positioned to be inserted into the main assembly, and shows the dimensional relationship between the two in terms of the longitudinal direction of the process cartridge.
Figure 2:
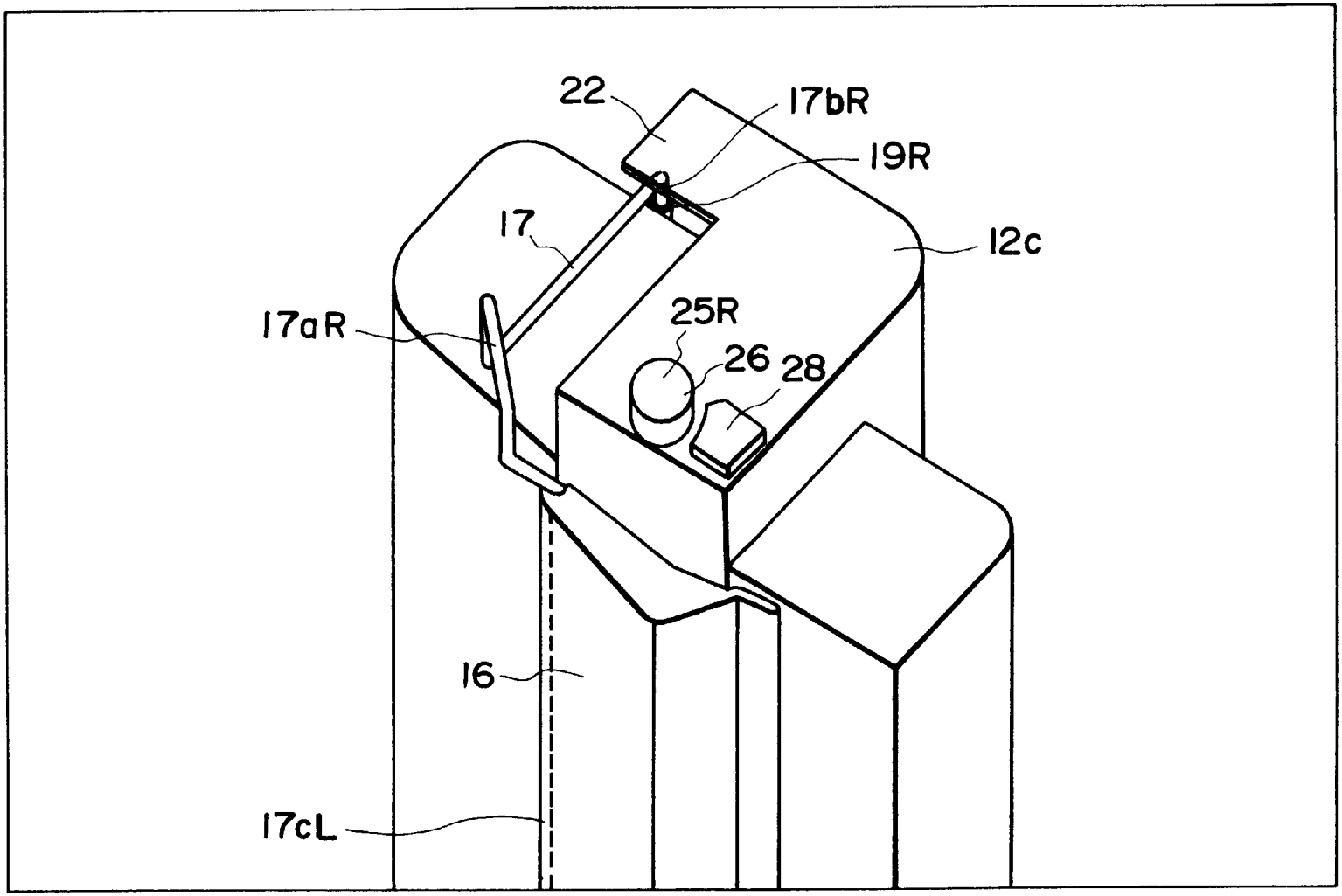
FIG. 2 is a perspective view of one of the longitudinal ends of the process cartridge in accordance with the present invention.

More specifically, referring to FIG. 1, a reference character H represents the distance between the internal surfaces 24L and 24R of the cartridge mounting space of the apparatus main assembly 13, and a reference character F represents the distance between the external surfaces 27L and 27R of the longitudinal and walls, that is, the length, of the process cartridge B. The shutter rod 17 and the apparatus main assembly are configured so that their dimensional relationship assures that even if the process cartridge B moves side to side (longitudinal direction of photosensitive drum 7) in the cartridge mounting space of the apparatus main assembly 13, by a distance as large as the difference H−F, the shutter rod 17 prevents the process cartridge B from coming in contact with the internal surfaces. Also referring to FIG. 1, the reference character e designates the distance (in terms of the longitudinal direction of photosensitive drum 7) between the outward tip of the contact portion 25L of the process cartridge B and the outward tip of the projecting portion 17*a*L of the shutter rod 17, and a reference character a designates the distance (in terms of the direction perpendicular to the direction in which process cartridge B is mounted) between the contact surface 23L and the internal surface 21L, on the outward side of the shutter catching portion 20L. The play between the process cartridge B and the apparatus main assembly 13 afforded in terms of the longitudinal direction of the process cartridge B is equivalent to the difference between the distance A' between the contact surfaces 23L and 23R of the apparatus main assembly 13, and the distance E between the outward tips of the contact portion 25L and 25R of the process cartridge B, i.e., the length of the process cartridge B. In this embodiment, the dimensional relationship between the shutter rod 17 and the apparatus main assembly is as follows, with a character G representing the aforementioned play, i.e., A'−E:

$$e>a+G.$$

Exactly speaking, the distance e is greater by 1.5 mm than the total of the distance a and the difference G. However, the value of the play G, that is, the difference between the distances A' and E, is smaller than the width of the narrower of the left and right mounting guides 15L and 15R.

Again referring to FIG. 1, the dimensional relationship between the shutter rod 17 and the apparatus main assembly 13, on the right-hand side of the apparatus, is as follows: if the outward tip of the projecting portion 17*a*R of the shutter rod 17 is on the outward side of the contact portion 25R of the process cartridge B, a distance f (in terms of the longitudinal direction of photosensitive drum 7) from the outward tip of the contact portion 25R to the outward tip of the 17*a*R, and a distance d from the contact surface 23R, on the right-hand side, of the apparatus main assembly 13, to the internal surface 21R, on the outward side of the shutter catching portion 20R, satisfies the following relationship: f<d. However, if the outward tip of the projecting portion 17*a*R is on the inward side of the outward tip of the contact portion 25R, the distance c (the height of a step in terms of the longitudinal direction of photosensitive drum 7) from the contact surface 23R and the internal surface 24R satisfies the following relationship: f<c−G. In this case, the play G has the following relation: G=A'−E.

The distance D between the outward tips of the projecting portions 17*a*L and 17*a*R, and the distance C between the internal surfaces 21L and 21R, on the outward side of the shutter catching portions 20L and 20R, respectively, have the following relationship: D<C.

With the presence of the above-described dimensional relationship among the pertinent points of the shutter rod 17 and the apparatus main assembly 13, even if the shutter rod 17 changes in shape, it is assured that the projecting portion 17*a*L of the shutter rod 17, on the left-hand side, comes in contact with the shutter catching portion 20L. It should be noted here that the shutter 16 is opened as long as one of the projection portions 17*a* (17*a*L and 17*a*R) of the shutter rod 17 is caught by the shutter catching portion 20L. In other words, it is assured that the shutter 16 never fails to be opened as the process cartridge B is inserted into the apparatus main assembly 13.

FIG. 13 is a top plan view of the process cartridge B in the apparatus main assembly 13. In the drawing, shutter 16 is at the retreat position. A referential characters 12*a*2 designates a handhold portion of the process cartridge B.

As the process cartridge B is inserted into the apparatus main assembly 13, the projecting portion 17*a*L of the shutter rod 17, on the left-hand side, comes in contact with the internal surface 21L. Since the outward tip of the projecting portion 17*a*L projects outward, in terms of the longitudinal direction of the photosensitive drum 7, from the position of the internal surface 21L by a distance of c−(a+G), the shutter rod 17 is pushed rightward by the internal surface 21L, on the outward side of the shutter catching portion 20L, being thereby moved rightward. As a result, the physical length by which the projecting portion 17*a*R on the right-hand side is caught by the shutter catching portion 20R on the right-hand side, increases. Meanwhile, on the left-hand side of the apparatus, the shutter rod 17 is caught by the shutter catching portion 20L, causing the shutter 16 to open. Consequently, the force which acts on the projecting portion 17*a*R, in the direction to disengage the projecting portion 17*a*R from the shutter catching portion 20R is greatly reduced, preventing the projecting portion 17*a*R from becoming disengaged from the shutter catching portion 20R.

Further, in this embodiment, the following relationship is given between the distance D between the outward tips of the projecting portions 17*a*L and 17*a*R of the shutter rod 17, and the distance C between the internal surfaces, on the outward side of the left- and right-hand side shutter catching portion 20: D<C.

With the presence of the above described dimensional relationship between the shutter rod 17 and the apparatus main assembly 13, the shutter rod 17 is moved rightward, creating a situation in which the rotational shaft portion 17*b*R of the shutter rod 17 may come out of the shutter rod hole 17R on the right-hand side of the apparatus. Thus, in this embodiment, the process cartridge B is provided with a blocking wall 22, which is positioned squarely on the right-hand side of the shutter rod hole 19R on the right-hand side, in other words, on the side to which the shutter rod 17 is caused to shift. With this arrangement, even if the shutter rod 17 receives from the internal surface 21L, on the outward side of the shutter catching portion 20L, such a force that pushes the shutter rod 17 rightward, the shutter rod 17 bumps into the blocking wall 22, thereby being prevented from shifting far enough to allow its rotational axis 17*b*R to disengage from the shutter rod hole 19R. The blocking wall 22 is formed as the extension of a portion of the drum frame 12*c*.

Figure 8:
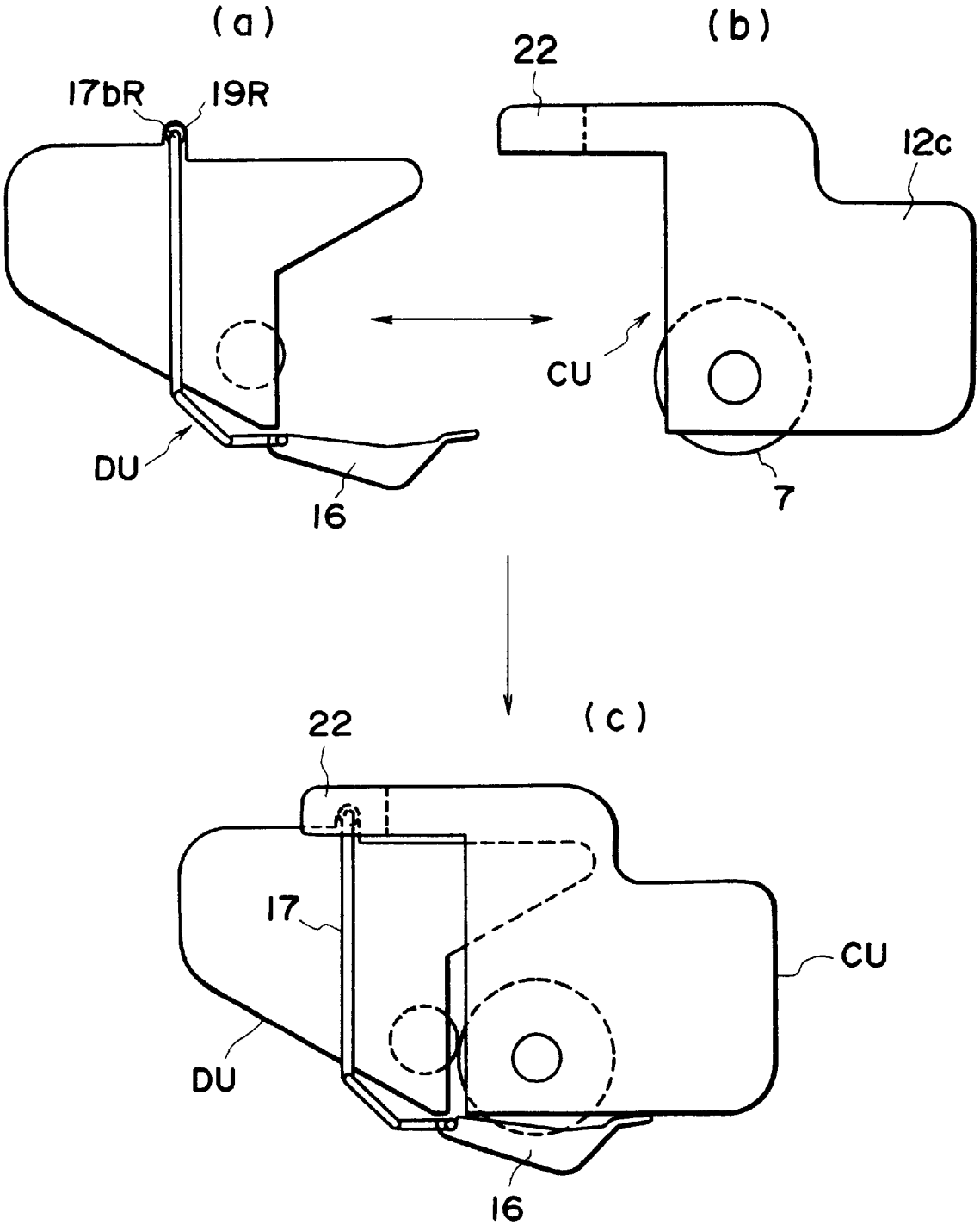
FIG. 8 is a plan view of the cleaning unit and the development unit of a process cartridge in accordance With the present invention, and depicts how the two units are united.

Referring to FIG. 8, (*a*), in this embodiment, the shutter rod 17 is attached to the frame of the development unit DU. As described above, the blocking wall 22 is constituted of a portion of the drum frame 12*c*, and extends in the direction of the development unit DU. In other words, as the development unit DU illustrated in FIG. 8, (*a*), the cleaning unit CU illustrated in FIG. 8, (*b*), are united into the process cartridge B illustrated FIG. 8, (*c*), the blocking wall 22 is positioned to block the direction in which the rotational axis portion 17*b*R of the shutter rod 17 is liable to disengage from the shutter rod hole 19R. Thus, according to this embodiment of the present invention, the shutter rod 17 can be prevented from disengaging from the shutter rod hole 19R, without using additional components, and also without increasing the number of assembly steps.

Embodiment 2

Next, the second embodiment will be described. The general structures of the process cartridge B, and the general structure of the image forming apparatus in which the process cartridge B is mountable, the structure of the shutter, and the dimensional relationship between the process cartridge B and the apparatus main assembly 13, are the same as those in the first embodiment. Therefore, their descriptions are omitted.

The difference between the first embodiment and this second embodiment of the present invention is in the structure for preventing the shutter rod 17 from becoming disengaged from the shutter rod hole 19. Thus, the structure in this embodiment for preventing the disengagement of the shutter rod 17 will be described.

Figure 10:
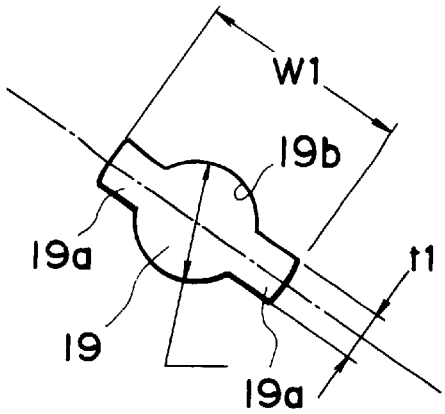
FIG. 10 is a schematic drawing which depicts the shape of the shutter rod hole in the second embodiment of the present invention.
Figure 11:
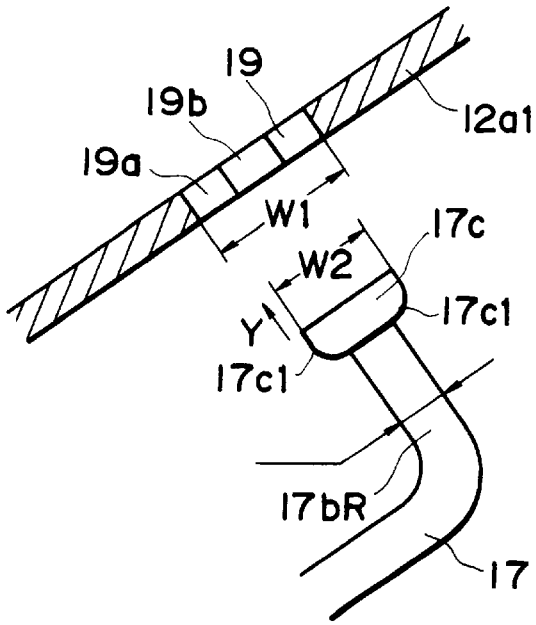
FIG. 11 is an enlarged cross section of the shutter rod hole and the rotational axis portion of the shutter rod, at a sectional plane designated with a referential character Z—Z in FIG. 9.
Figure 12:
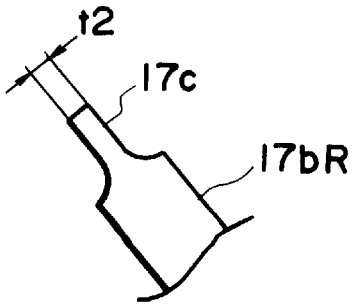
FIG. 12 is a schematic drawing which depicts the shape of the tip or one of the longitudinal ends of the rotational axis portion of the shutter rod hole, in the second embodiment of the present invention.

Referring to FIGS. 11 and 12, the tip portion of the aforementioned rotational axis 17*b*R is provided with a rectangular portion 17*c*, being approximately rectangular in its cross section at a plane perpendicular to the axial line of the rotational axis 17*b*R. In other words, the rectangular portion 17*c* consists of the projecting portions 17*c*1 which extend in the radial direction from the peripheral surface of the tip portion of the rotational axis of the 17*b*R. Referring to FIG. 10, the shutter rod hole 19 consists of a bearing portion 19*b*, in which the rotational axis portion 17*b*R it allowed to freely rotate, and a pair of opposing groove portions 19*a*, the depth direction of which coincides with the radial direction of the bearing portion 19*b*.

The dimensional relationship between the rectangular portion 17*c* and the shutter rod hole 19 is as follows: the distance W1 between the bottoms of the opposing groove portions 19*a*, the width t1 of the groove portion 19*a*, width W2 of the rectangular portion 17*c*, the thickness t2 of the rectangular portion 17*c*, and the diameter D1 of the rotational axis portion 17*b*R, satisfy the following relationship:

$$W1>W2 \text{ and } t1>t2$$

$$W1>D1>>t1.$$

However, the difference between the t1 and t2 is very small, and the mathematical character ">>" is used to signify that the t1 is substantially smaller than D1.

Figure 9:
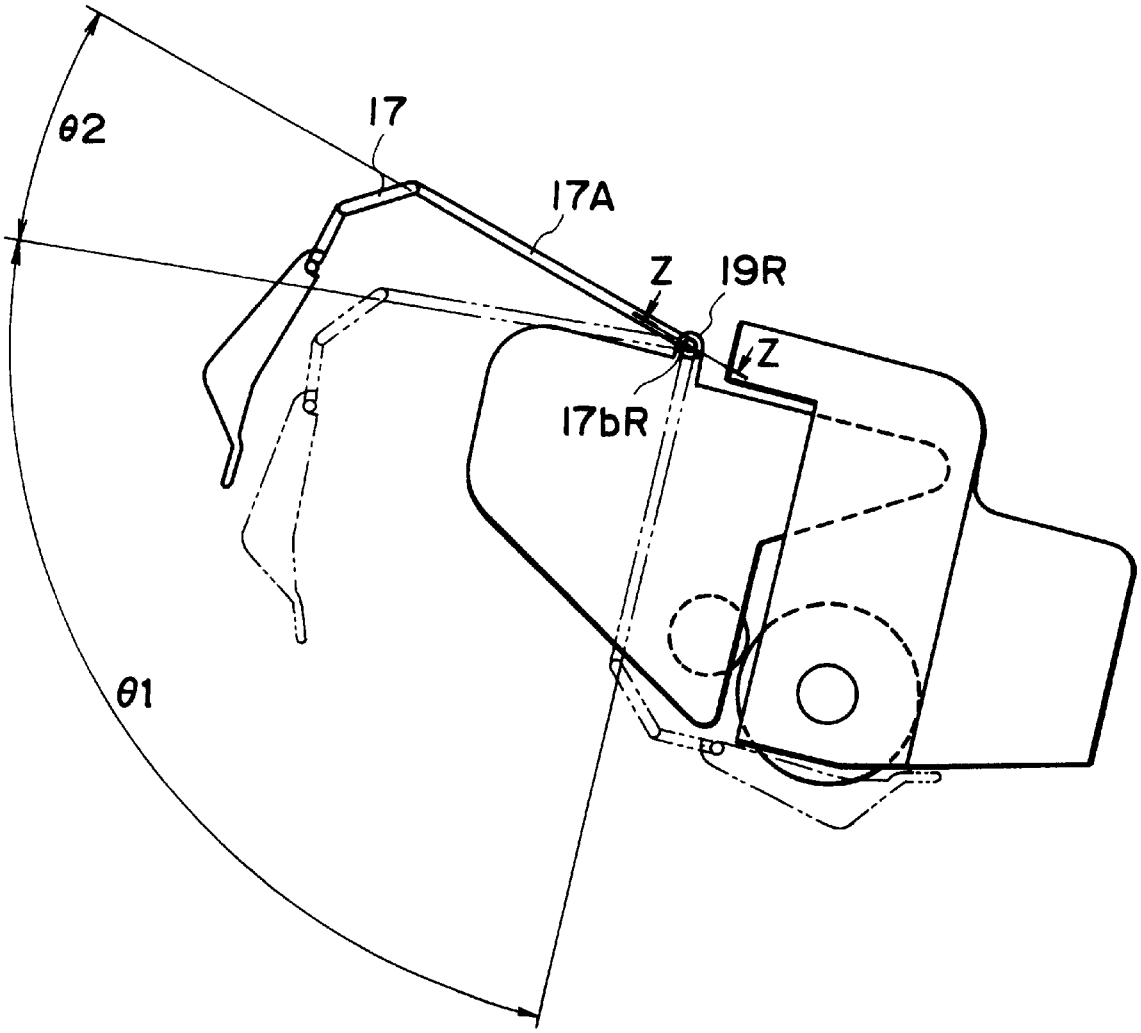
FIG. 9 is a side view of the process cartridge in the second embodiment of the present invention, and depicts the rotational range of the shutter rod.

The shutter rod 17 is attached in the following manner: first, the shutter rod 17 is positioned so that the longitudinal edges of the rectangular portion 17*c* of the tip portion of the rotational axis portion 17*b*R become approximately parallel to the line drawn through the centers of the bottom portions of the groove portion 19*a* of the shutter rod hole 19. Then, the rectangular portion 17*c* is put through the shutter rod hole 19, in the direction indicated by an arrow mark Y (FIG. 11), so that the rectangular portion 17*c* enters the space behind the wall 12*a*1 of the toner container 12*a*. The process cartridge B in this embodiment is configured so that the rectangular portion 17*c* of the shutter rod 17 does not become aligned with the opposing groove portions 19*a* of the shutter rod hole 19 as long as the shutter rod 17 remains within its normal operational range, i.e., the angle designated with a reference character θ1 in FIG. 9, when the process cartridge B is mounted into, or removed from, an image forming apparatus. More specifically, the shutter rod hole 19 is configured so that the rectangular portion 17*c* aligns with the shutter rod hole 19 only when the shutter rod section 17A is at the position designated with a reference character K, which is slightly outside the normal operational range of the shutter rod 17 by an angle of θ2. Therefore, when the process cartridge B is mounted into, or removed from, the apparatus main assembly 13, the rectangular portion 17*c* of the shutter rod 17, and the opposing groove portions 19*a*, never align. With this arrangement, even if the shutter rod 17 receives the aforementioned force from the internal surface 21L, on the outward side of the shutter catching portion 20L, the projecting portion 17*c*1 interferes with the wall 12*a*1 as the regulating member. Therefore, the rotational axis portion 17*b*R of tho shutter rod 17 is prevented from becoming disengaged from the shutter rod hole 19.

The embodiments are summarized as follows:

A process cartridge (e.g. B) detachably mountable to a main assembly (e.g. 13) of an electrophotographic image forming apparatus, comprising:

a cartridge frame (e.g. 12*a*, 12*b* and 12*c*);

an electrophotographic photosensitive member (e.g. 7);

process means (e.g. 8, 10 or 11) actable on the photosensitive member;

a shutter (e.g. 16) for covering a portion of the photosensitive member which is otherwise exposed;

a shutter supporting member (e.g. 17, 30) for supporting said shutter on the cartridge frame, for movement between a protecting position for covering the photosensitive member to protect it and a retracted position for permitting the photosensitive member to be exposed;

a force receiving portion (e.g. 17*a*L) for receiving, when the process cartridge is mounted to the main assembly of the image forming apparatus, a force for urging the shutter supporting member longitudinally inwardly of the process cartridge, wherein the force receiving portion is contactable to the main assembly when said processing cartridge is mounted to the main assembly; and a stopper (e.g. 22, 12*a*1) for limiting movement of the shutter supporting member beyond a predetermined distance to prevent the shutter member from disengaging from the cartridge frame, when the shutter supporting member moves in the longitudinal direction of the shutter.

The shutter supporting member is an integrally formed member, has one and the other ends which are rotatably mounted on the cartridge frame, and is coupled with the shutter along the longitudinal direction of the shutter.

The force receiving portion is provide in the shutter supporting member, and is projected outwardly in a longitudinal direction of the cartridge frame.

The force receiving portion is provided at one longitudinal end of said process cartridge, and the stopper is provided at the other longitudinal end.

The cartridge frame has a drum frame (e.g. 12*c*) supporting the photosensitive member in the form of a drum and a developing frame (e.g. 12*b*) supporting a developing roller (e.g. 10*d*) for developing an electrostatic latent image formed on the photosensitive member, wherein one end portion and the other end portion of the shutter supporting member are mounted to the developing frame, wherein the stopper is provided in the drum frame, and wherein the drum frame and the developing frame are rotatably coupled with each other.

The stopper is integrally formed with the drum frame, and the stopper is projected from the drum frame in a direction crossing with the longitudinal direction of the process cartridge, and wherein the stopper and the drum frame are composed of plastic resin material.

The shutter supporting member is composed of metal rod, and the force receiving portion is a bent portion of the rod.

The cartridge frame and the shutter are composed of plastic resin material which may be polystyrene, ABS (acrylonitrile/butadien/styrene copolymer), polycarbonate, polyethylene, polypropylene or the like resin material.

As described above, according to this embodiment, it is assured that the shutter of a process cartridge B never fails to be opened when the process cartridge B is mounted into the apparatus main assembly 13 of an image forming apparatus. Further, the reliability of the shutter in terms of opening the shutter can be improved without an increase in the size and cost of the apparatus.

While the invention has been described with reference to the structures disclosed herein, it is not confined to the details set forth, and this application is intended to cover such modifications or changes as may come within the purposes of the improvements or the scope of the following claims.

What is claimed is:

1. A process cartridge detachably mountable to a main assembly of an electrophotographic image forming apparatus, comprising:

a cartridge frame;

an electrophotographic photosensitive member;

process means actable on said photosensitive member;

a shutter for covering a portion of said photosensitive member which is otherwise exposed;

a shutter supporting member for supporting said shutter on said cartridge frame, for movement between a protecting position for covering said photosensitive member to protect it and a retracted position for permitting said photosensitive member to be exposed;

a force receiving portion for receiving, when said process cartridge is mounted to the main assembly of the image forming apparatus, a force for moving said shutter from said protecting position to said retracted position and for urging said shutter supporting member longitudinally inwardly of said process cartridge, wherein said force receiving portion is contactable to the main assembly when said process cartridge is mounted to the main assembly; and a stopper for limiting movement of said shutter supporting member beyond a predetermined distance to prevent said shutter from disengaging from said cartridge frame, when said shutter supporting member moves longitudinally inwardly with respect said process cartridge.

2. A process cartridge according to claim 1, wherein said shutter supporting member is an integrally formed member, has one and the other ends which are rotatably mounted on said cartridge frame, and is coupled with said shutter along the longitudinal direction of the shutter.

3. A process cartridge according to claim 1 or 2, wherein said force receiving portion is provided in said shutter supporting member, and is projected outwardly in a longitudinal direction of said cartridge frame.

4. A process cartridge according to claim 1 or 2, wherein said force receiving portion is provided at one longitudinal end of said process cartridge, and said stopper is provided at the other longitudinal end.

5. A process cartridge according to claim 4, wherein said cartridge frame has a drum frame supporting said photosensitive member in the form of a drum and a developing frame supporting a developing roller for developing an electrostatic latent image formed on said photosensitive member, wherein one end portion and the other end portion of said shutter supporting member are mounted to said developing frame, wherein said stopper is provided in said drum frame, and wherein said drum frame and said developing frame are rotatably coupled with each other.

6. A process cartridge according to claim 5, wherein said stopper is integrally formed with said drum frame, and said stopper is projected from said drum frame in a direction crossing with the longitudinal direction of the process cartridge, and wherein said stopper and said drum frame are composed of plastic resin material.

7. A process cartridge according to claim 6, wherein said shutter supporting member is composed of metal rod, and said force receiving portion is a bent portion of the rod.

8. A process cartridge according to claim 1, wherein said process means includes at least one of charging means for charging said photosensitive member, developing means for developing an electrostatic latent image formed on said photosensitive member and cleaning means for removing residual toner from said photosensitive member.

9. A process cartridge detachably mountable to a main assembly of an electrophotographic image forming apparatus, comprising:

a drum frame;

a developing frame rotatable relative to said drum frame, said developing frame including a toner frame having a toner accommodating portion accommodating toner to be used for development;

an electrophotographic photosensitive drum supported on said drum frame;

a charging member for charging said photosensitive drum supported on said drum frame;

a charging roller, supported on said drum frame, for charging said photosensitive drum;

a developing roller for developing an electrostatic latent image formed on said photosensitive drum;

a shutter for covering a portion of said photosensitive drum which is otherwise exposed from a combination of said drum frame and said developing frame, wherein said shutter is movable between a protecting position for covering said photosensitive drum to protect it and a retracted position for permitting said photosensitive drum to be exposed;

a shutter supporting member for supporting said shutter on said developing frame, for movement between the protecting position and the retracted position, wherein said shutter supporting member is an integrally formed member, has one and the other ends which are rotatably mounted on said developing frame, and is coupled with said shutter along the longitudinal direction of the shutter;

a force receiving portion for receiving, when said process cartridge is mounted to the main assembly of the image apparatus, a force for moving said shutter from said protecting position to said retracted position and for urging said shutter supporting member longitudinally inwardly of said process cartridge, wherein said force receiving portion is contactable to the main assembly when said process cartridge is mounted to the main assembly, wherein said force receiving portion is provided in said shutter supporting member, and is projected outwardly in a longitudinal direction of said developing frame; and a stopper for limiting movement of said shutter supporting member beyond a predetermined distance to prevent said shutter from disengaging from said cartridge frame, when said shutter supporting member moves longitudinally inwardly with respect to said process cartridge, wherein said force receiving position is provided at one longitudinal end of said process cartridge, and said stopper is provided at the other longitudinal end, and wherein said process cartridge is mounted in the main assembly in a direction crossing with said photosensitive drum with said drum frame at a leading side and said developing frame and said toner frame at a trailing side.

10. A process cartridge according to claim 9, wherein said stopper is integrally formed with said drum frame, and said stopper is projected from said drum frame in a direction crossing with the longitudinal direction of the process cartridge, and wherein said stopper and said drum frame are composed of plastic resin material.

11. A process cartridge according to claim 9 or 10, wherein said shutter supporting member is composed of metal rod, and said force receiving portion is a bent portion of the rod.

12. An electrophotographic image forming apparatus for forming an image on a recording material, to which a process cartridge is detachably mountable, comprising:

(a) a mounting member for detachably mounting the process cartridge, said process cartridge including:

a cartridge frame;

an electrophotographic photosensitive member;

process means actable on said photosensitive member;

a shutter for covering a portion of said photosensitive member which is otherwise exposed;

a shutter supporting member for supporting said shutter on said cartridge frame, for movement between a protecting position for covering said photosensitive member to protect it and a retracted position for permitting said photosensitive member to be exposed;

a force receiving portion for receiving, when said process cartridge is mounted to the main assembly of the image forming apparatus, a force for moving said shutter from said protecting position to said retracted position and for urging said shutter supporting member longitudinally inwardly with respect to said process cartridge, wherein said force receiving portion is contactable to the main assembly when said process cartridge is mounted to the main assembly; and a stopper for limiting movement of said shutter supporting member beyond a predetermined distance to prevent said shutter supporting member beyond a predetermined stance to prevent said shutter from disengaging from said cartridge frame, when said shutter supporting member moves longitudinally inwardly with respect to said process cartridge; and (b) a wall protection which said force receiving portion of said process cartridge abuts when said process cartridge is mounted to the main assembly.

13. An electrophotographic image forming apparatus for forming an image on a recording material, to which a process cartridge is detachably mountable, comprising:

(a) a mounting member for detachably mounting the process cartridge, said process cartridge including:

a drum frame;

a developing frame rotatable relative to said drum frame, said developing frame including a toner frame having a toner accommodating portion accommodating toner to be used for developing;

an electrophotographic photosensitive drum supported on said drum frame;

a charging member for charging said photosensitive drum supported on said drum frame;

a developing roller for developing an electrostatic latent image formed on said photosensitive drum;

a shutter for covering a portion of said photosensitive drum which is otherwise exposed from a combination of said drum frame and said developing frame, wherein said shutter is movable between a protecting position for covering said photosensitive drum to protect it and a retracted position for permitting said photosensitive drum to be exposed;

a shutter supporting member for supporting said shutter on said developing frame, for movement between the protecting position and the retracted position, wherein said shutter supporting member is an integrally formed member, has one and the other ends which are rotatably mounted on said cartridge frame, and is coupled with said shutter along the longitudinal direction of the shutter;

a force receiving portion for receiving, when said process cartridge is mounted to the main assembly of the image forming apparatus, a force for urging said shutter supporting member longitudinal inwardly with respect to said process cartridge, wherein said force receiving portion is contactable to the main assembly when said process cartridge is mounted to the main assembly, wherein said force receiving portion is provided in said shutter supporting member, and is projected outwardly in a longitudinal direction of said cartridge frame; and a stopper for limiting movement of said shutter supporting member beyond a predetermined distance to prevent said shutter from disengaging from said cartridge frame, when said shutter supporting member move longitudinally inwardly with respect to said process cartridge, wherein said force receiving portion is provided at one longitudinal end of said process cartridge, and said stopper is provided at the other longitudinal end, and wherein said process cartridge is mounted in the main assembly in a direction crossing with said photosensitive drum with said drum frame at a leading said and said developing frame and said toner frame at a trailing side; and (b) a wall portion which said force receiving portion of said process cartridge abuts when said process cartridge is mounted to the main assembly.

* * * * *

UNITED STATES PATENT AND TRADEMARK OFFICE

CERTIFICATE OF CORRECTION

PATENT NO. : 6,078,764

DATED : June 20, 2000

INVENTOR(S): Takashi AKUTSU

It is certified that error appears in the above-identified patent and that said Letters Patent is hereby corrected as shown below:

COLUMN 1:

Line 11, "Example" should read --Examples--.
Line 12, "includes" should read --include--.
Line 36, "acts" should read --act--.
Line 53, "cartridge" should read --cartridges--.

COLUMN 2:

Line 2, "above described" should read --above-described--.
Line 12, "portion" should read --position--.
Line 60, "With" should read --with--.

COLUMN 3:

Line 58, "mean" should read --means--.

COLUMN 5:

Line 19, "the" (first occurrence) should be deleted.
Line 35, "an" should read --a--.

UNITED STATES PATENT AND TRADEMARK OFFICE

CERTIFICATE OF CORRECTION

PATENT NO. : 6,078,764

DATED : June 20, 2000

INVENTOR(S) : Takashi AKUTSU

It is certified that error appears in the above-identified patent and that said Letters Patent is hereby corrected as shown below:

COLUMN 6:

Line 12, "and" should read --end--.

COLUMN 7:

Line 18, "characters" should read --character--.
Line 46, "above described" should read --above-described--.

COLUMN 8:

Line 5, "illustrated" should read --illustrated in--.
Line 39, "it" should read --is--.

COLUMN 9:

Line 21, "tho" should read --the--.
Line 46, "processing" should read --process--

UNITED STATES PATENT AND TRADEMARK OFFICE

CERTIFICATE OF CORRECTION

PATENT NO. : 6,078,764

DATED : June 20, 2000

INVENTOR(S): Takashi AKUTSU

It is certified that error appears in the above-identified patent and that said Letters Patent is hereby corrected as shown below:

COLUMN 10:

Line 59, "respect" should read --respect to --.

COLUMN 14:

Line 4, "longitudinal" should read --longitudinally--.
Line 16, "move" should read --moves--.
Line 23, "leading said" should read --leading side--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*